US010801343B2

(12) United States Patent
Urac et al.

(10) Patent No.: US 10,801,343 B2
(45) Date of Patent: Oct. 13, 2020

(54) SELF RETAINING FACE SEAL DESIGN FOR BY-PASS STATOR VANES

(71) Applicant: PRATT & WHITNEY CANADA CORP., Longueuil (CA)

(72) Inventors: Tibor Urac, Mississauga (CA); Bernadette Mason, Milton (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 704 days.

(21) Appl. No.: 15/381,450

(22) Filed: Dec. 16, 2016

(65) Prior Publication Data

US 2018/0171809 A1 Jun. 21, 2018

(51) Int. Cl.
*F01D 9/04* (2006.01)
*F01D 11/00* (2006.01)

(52) U.S. Cl.
CPC ..... *F01D 9/042* (2013.01); *F01D 11/005* (2013.01); *F05D 2250/294* (2013.01)

(58) Field of Classification Search
CPC ... F01D 9/042; F01D 11/005; F05D 2250/294
USPC ..... 415/209.3
See application file for complete search history.

(56) References Cited

U.S. PATENT DOCUMENTS 3,997,280 A * 12/1976 Germain ..... F01D 9/042 415/189
4,940,386 A * 7/1990 Feuvrier ..... F01D 9/04 415/189
5,630,700 A * 5/1997 Olsen ..... F01D 5/189 415/134
6,464,456 B2 * 10/2002 Darolia ..... F01D 5/3084 415/134
7,637,718 B2 * 12/2009 Barnett ..... F01D 9/042 415/119
9,494,039 B2 * 11/2016 Von Arx ..... F01D 5/005
9,951,639 B2 * 4/2018 Ivakitch ..... F01D 9/042
9,995,160 B2 * 6/2018 Sarawate ..... F01D 9/065
10,060,278 B2 * 8/2018 Boeck ..... F01D 11/005
2007/0098548 A1 * 5/2007 Barnett ..... F02C 7/05 415/209.3
2007/0098557 A1 * 5/2007 Barnett ..... F02C 7/05 416/193 A
2010/0080699 A1 * 4/2010 Pietrobon ..... F01D 11/005 415/220

(Continued)

*Primary Examiner* — David Hamaoui
*Assistant Examiner* — John D Bailey
(74) *Attorney, Agent, or Firm* — Norton Rose Fulbright Canada LLP

(57) ABSTRACT

A vane assembly adapted to be disposed through an annular gas flow path defined between a fan case and an engine core of a gas turbine engine. The assembly comprises a vane having a vane body configured for extending between the engine core and the fan case, a vane head disposed at one end of the vane body, the vane head being adapted to be disposed outside the annular gas flow path, the vane head having an abutting surface configured for contacting an outer surface of the fan case, and a recess extending within the vane head and opening to the abutting surface. The recess is configured for circumferentially surrounding a longitudinal axis of the vane and forming a closed figure. The assembly also comprises a sealing member disposed within the recess.

20 Claims, 3 Drawing Sheets

(56) References Cited

U.S. PATENT DOCUMENTS

| | | | | |
|---|---|---|---|---|
| 2012/0009071 | A1* | 1/2012 | Tanahashi | F16J 15/062<br>416/241 B |
| 2013/0205800 | A1* | 8/2013 | Ivakitch | F01D 11/005<br>60/805 |
| 2016/0032748 | A1* | 2/2016 | Boeck | F01D 17/14<br>415/115 |
| 2016/0115807 | A1* | 4/2016 | Davis | F01D 11/005<br>277/592 |
| 2016/0115813 | A1* | 4/2016 | Davis | F16J 15/0887<br>277/592 |
| 2016/0222812 | A1* | 8/2016 | Sippel | F01D 11/08 |
| 2016/0258308 | A1* | 9/2016 | Davis | F16J 15/104 |
| 2018/0149031 | A1* | 5/2018 | Sippel | F01D 11/005 |

* cited by examiner

SELF RETAINING FACE SEAL DESIGN FOR BY-PASS STATOR VANES

TECHNICAL FIELD

The application relates generally to gas turbine engine, and more particularly to insertable stator vanes.

BACKGROUND OF THE ART

Some gas turbine engines, such as turbofan engines, comprise a fan case, an engine core, and an annular flow passage disposed therebetween. Engine rotors are typically followed by row(s) of stator vanes. Vanes may be provided in segments, but may also be provided as individually insertable vanes. The vanes are usually individually manufactured from a molding and/or machining process and are radially inserted inside the engine case through the annular gas flow passage.

To minimize leakage between the vane and the case, a grommet may be disposed between the external surface of the case and the vane head. However, the grommet may be subjected to air leaks which may affect the engine's performance.

SUMMARY

In one aspect, there is provided a vane assembly adapted to be disposed in a gas flow path defined by a case of a gas turbine engine, comprising a vane having a vane body configured for extending through a vane-receiving aperture in the case, a vane head disposed at one end of the vane body and configured to be disposed outside the gas flow path when the vane is inserted into the vane-receiving aperture, the vane head having an abutting surface configured for contacting an outer surface of the case when the vane is inserted into the vane-receiving aperture, and a recess extending within the vane head and opening to the abutting surface, the recess circumferentially extending around a longitudinal axis of the vane, and a sealing member disposed within the recess.

In another aspect, there is provided a fan case assembly of a gas turbine engine, comprising a fan case defining an annular gas flow path and having a plurality of vanes configured for extending between an engine core of the gas turbine engine and the fan case, at least one vane of the plurality of vanes having a vane body disposed through a vane-receiving aperture defined in the fan case and a vane head disposed outside the annular gas flow path, the vane head defining an abutting surface contacting an outer surface of the fan case, the vane head further defining a recess extending within the vane head and opening to the abutting surface and circumferentially extending around a longitudinal axis of the vane and forming a closed figure, the assembly further comprising a sealing member disposed within the recess.

In yet another aspect, there is provided a method for creating a sealing engagement between a case of a gas turbine engine and a vane extending through a gas flow path defined by the case of the gas turbine engine, the method comprising receiving a sealing member within a recess extending within a vane head and opening to an abutting surface of the vane head, the recess circumferentially extending around a longitudinal axis of the vane and forming a closed figure; creating a contact between the abutting surface of the vane head and an outer surface of the case once a vane body of the vane is inserted through a vane-receiving aperture defined through the case; and concurrently compressing the sealing member inside the recess.

DESCRIPTION OF THE DRAWINGS

Reference is now made to the accompanying figures in which.

DETAILED DESCRIPTION

Figure 1:
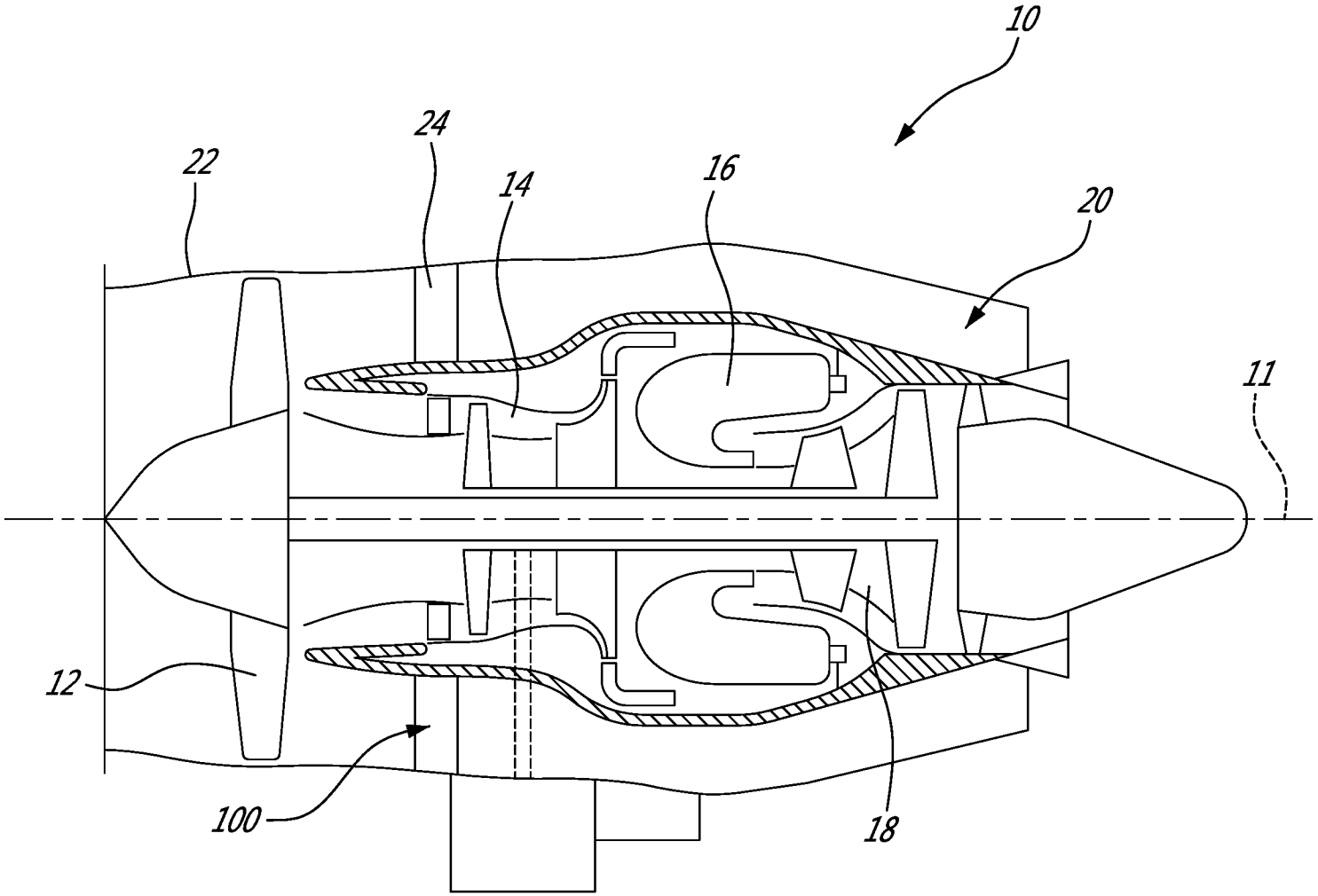
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

In the case of turbofan engine 10, an annular gas flow path 20 is defined between a fan case 22 and the engine core of the engine 10. The engine core may include the compressor 14, the combustor 16, and the turbine 18, among other components. The fan case 22 is disposed around the engine core and structurally supported by by-pass stator vanes 24. The by-pass stator vanes 24 are circumferentially distributed around the engine core and extend between the engine core and the fan case 22. In one embodiment, the by-pass stator vanes 24 are disposed in an axial position upstream of the compressor 14 relative to a direction of the flow and downstream of the fan 12. The by-pass stator vanes 24 may be disposed at any suitable location.

Figure 2:
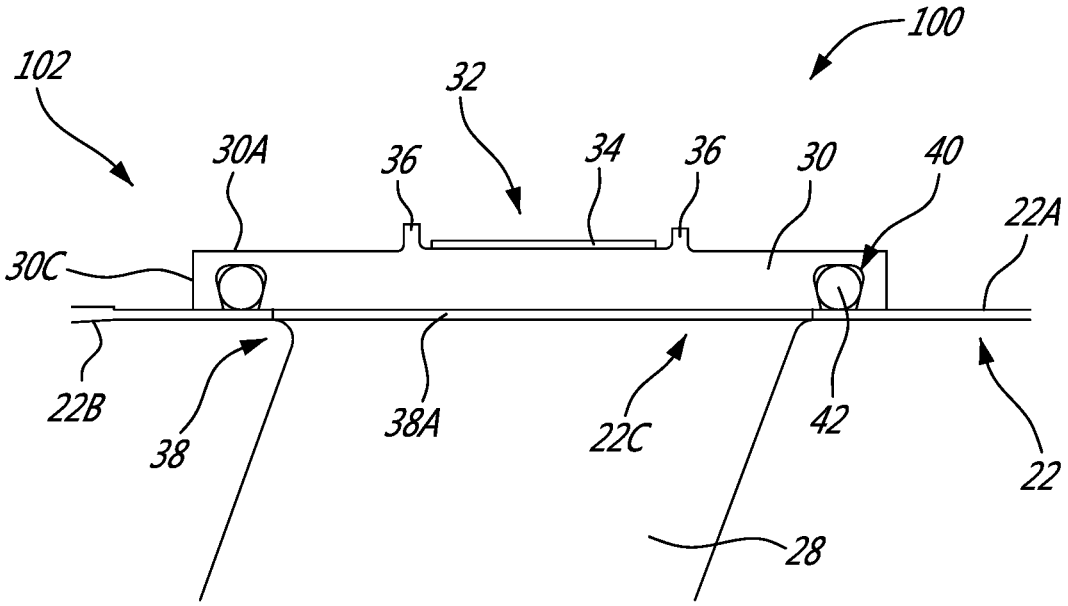
FIG. 2 is a perspective view of a portion of a by-pass vane.

Referring to FIGS. 1 and 2, the fan case 22 defines an outer surface 22A, an inner surface 22B and a plurality of vane-receiving apertures 22C extending from the inner surface 22B toward the outer surface 22A of the fan case 22. The vane-receiving apertures 22C are circumferentially distributed around the fan case 22 and are configured to receive the by-pass vanes 24 that extends through the annular gas flow path 20 as described herein above.

Figure 3:
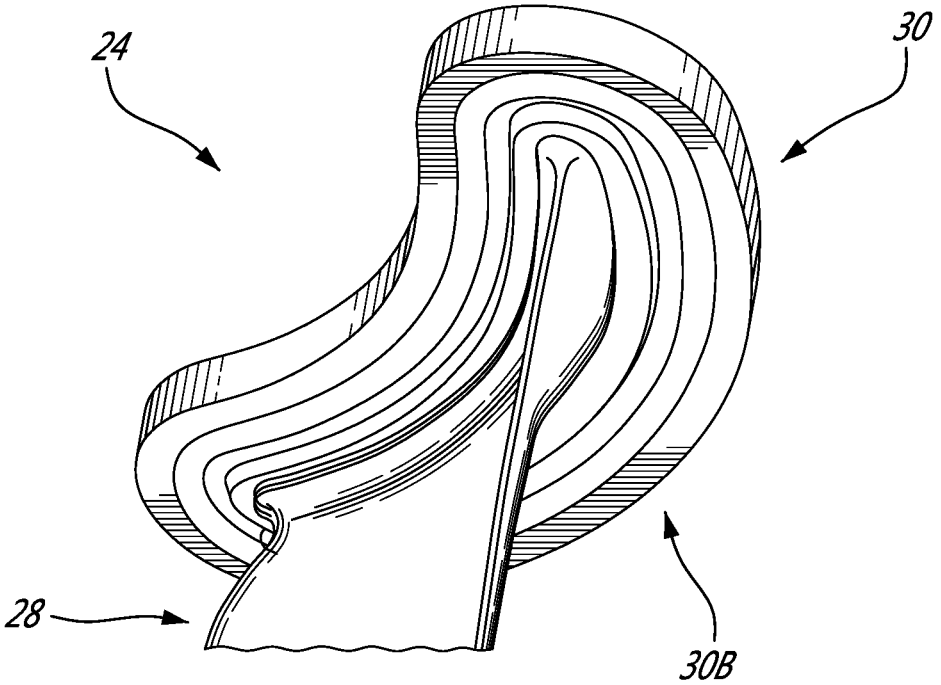
FIG. 3 is a chord wise cross-sectional view of the by-pass vane of FIG. 2.

Referring to FIGS. 2 and 3, each by-pass stator vane 24 comprises a vane body 28 and a vane head 30 disposed at one extremity or end of the vane body 28. The vane head 30 has a cross-section along a longitudinal axis of the vane 24 greater than a cross-section of the vane body 28. The vane body 28 is disposed through the vane-receiving aperture 22C defined by the fan case 22 whereas the vane head 30 remains outside the annular gas flow path 22 and abuts against the outer surface 22A of the fan case 22. Such an arrangement will be discussed herein below. The vane-receiving aperture 22C is thus configured such that the head 30 of the corresponding vane 24 is prevented from passing through the fan case 22. In one embodiment, the vane body 28 has an airfoil-shaped cross-section.

The vane head 30 defines an outer surface 30A that may include a strap holder 32 for receiving a corresponding fastening strap 34 or other member used to fasten and retain the vanes 24 in place within the fan case 22. In one embodiment, the strap 34 extends circumferentially over the strap holder 32 of all by-pass stator vanes 24 of the engine 10. In the particular embodiment shown in FIG. 3, the strap holder 32 includes two elongated and axially spaced-apart fingers 36 extending outwardly from the outer surface 30A of the vane head 30. In an alternate embodiment, the strap holder 32 is in the form of a circumferential groove defined in the outer surface 30A. Any other suitable mean may be used to maintain the vane head 24 in their position, such as, but not limited to clamps, fasteners, passages, channels, and the like. In an embodiment, the outer surface 30A is smooth and without a strap holder 32, the strap holder 32 relying on friction or on other components on the fan case 22 to remain in position.

The vane head 30 further defines an abutting surface 30B that may intersect with an end of the vane body 28, and/or may be generally transverse to the vane body 28. The abutting surface 30B is configured for directly contacting the outer surface 22A of the fan case 22 when the by-pass vane body 28 is inserted through the vane-receiving aperture 22C and through the annular gas flow path 20. In one embodiment, the outer surface 22A is cylindrical or conical. The abutting surface 30B of the vane head 30 may therefore have an arcuate surface complementary to the shape of the outer surface 22A as it is configured to contact the outer surface 22A of the fan case 22. Accordingly, the abutting surface 30B of the vane head 30 is configured for matching a shape of the outer surface 22A of the fan case 22.

The junction between the vane body 28 and the vane head 30 defines an intersection, or a neck 38. In one embodiment, the neck 38 is chamfered or has a fillet, for instance, to limit constraint concentration. The neck 38 further defines a radial surface 38A. The radial surface 38A is configured for contacting a periphery of a vane-receiving aperture 22C defined in the fan case 22. Accordingly, the radial surface 38A has a height taken along the radial direction generally matching a thickness of the fan case 22 between the inner and outer surfaces 22A and 22B of the fan case 22. The contact between the radial surface 38A and the vane-receiving aperture 22C may limit lateral movement of the by-pass vane 24 relative to the fan case 22.

In one embodiment, the radial surface 38A and the vane-receiving aperture 22C have matching shapes such that the radial surface 38A is in direct contact with the fan case 22. However, in another embodiment, the vane-receiving aperture 22C may be bigger and a filler may be used to fill the gap between the vane-receiving aperture 22C and the neck 38A. Accordingly, the filler would be disposed between the inner surface 22B and the outer surface 22A of the fan case 22 and would be contacting the radial surface 38A and the vane-receiving aperture 22C.

Figure 4A:
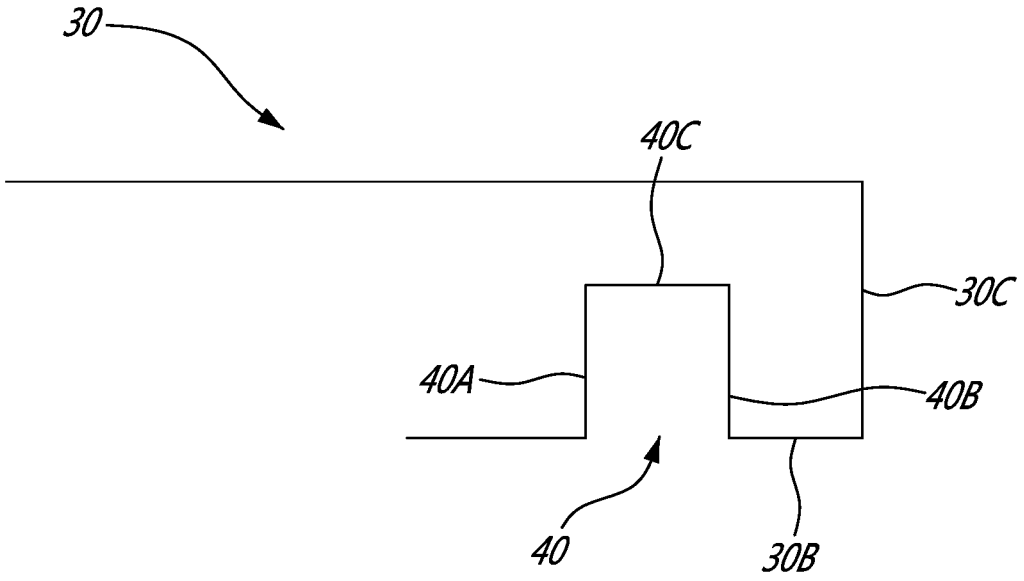
FIG. 4A is an enlarged portion of the view of FIG. 2.

Now referring to FIGS. 2 and 4A, the vane head 30 further has a recess or cavity 40 extending within the vane head 30 and circumferentially extending around a longitudinal axis of the vane body 28. The cavity 40 extends in the vane head 30 from the abutting surface 30B toward the outer surface 30A of the vane head 30. Accordingly, an entry to the cavity 40 is defined in the abutting surface 30B such that the cavity 40 opens to the abutting surface 30B. The cavity 40 defines a closed figure.

The recess 40 may be machined by removing matter from the vane head 30. Alternatively, the recess 40 may be created in the moulding process or casting process of the vane 24. Any manufacturing process known in the art may be used to create the vane 24 with the recess 40.

A sealing member 42 is disposed within the cavity 40. In one embodiment, the sealing member 42 may be an o-ring made of elastomeric material capable of sustaining the temperatures and pressures of a gas turbine engine. However, any other suitable sealing member made of any suitable material may be used without departing for the scope of the present disclosure, provided the material is non-rigid in that it is resilient or readily deformable (e.g., gasket fabric). A vane assembly 100 thus comprises the vane head 24 and the sealing member 42. A fan case assembly 102 comprises the fan case 22 and a plurality of vane assemblies 100.

The sealing member 42 is received inside the cavity 40 defined by two radial surfaces 40A and 40B and by a circumferential surface 40C. The surfaces 40A and 40B may be angled such as to retain the sealing member captive when the vane 24 is not disposed through the fan case 22. Such angle may facilitate installation of the vane 24 in the fan case 22. By being angled or by having a throat, an opening of the cavity 40 would be narrower than the remainder of the cavity 40 behind it.

Figure 4B:
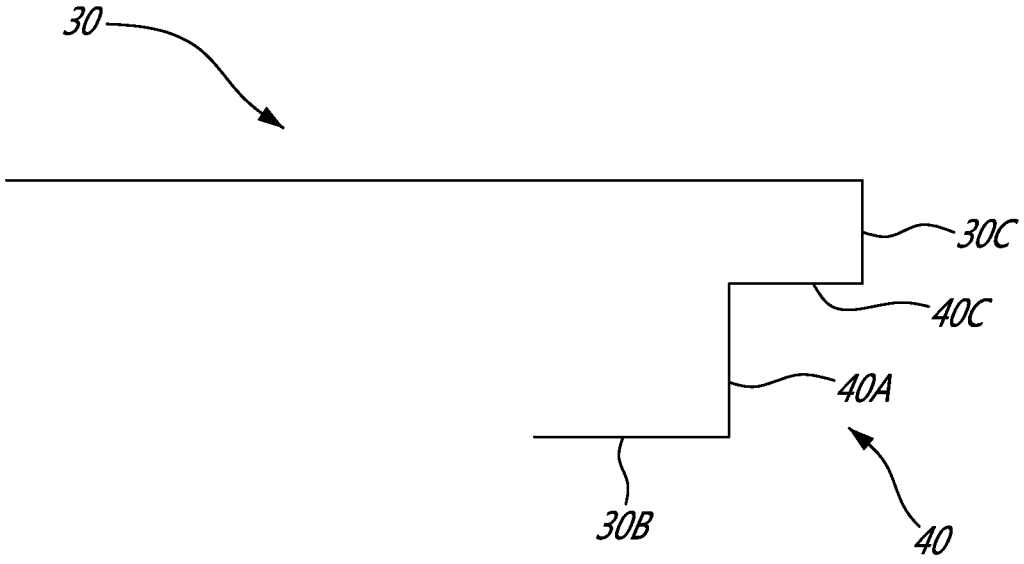
FIG. 4B is an enlarged portion of a chord wise cross-sectional view a by-pass vane in accordance with another embodiment.

Now referring to FIG. 4B, the groove 40 extends from the radial peripheral surface 30C of the vane head 30 and from the abutting surface 30B of the vane head 30. In this case, the sealing member 42, when inserted, will be constrained only by one radial surface 40A and by a circumferential surface 40C of the groove 40. It may also be desired to angle the surface 40C toward the fan case 22 to retain the sealing member 42 within the recess or groove 40 when it is compressed against the fan case 22. This embodiment allows replacement of the sealing member 42 without having to remove the by-pass vane 24 from the fan case 22.

In all embodiments, the sealing member 42 is configured such that the abutting surface 30B does not contact the outer surface 22A of the fan case 22 inasmuch as there is no force applied to the vane head 30. As described herein above, the strap 34 will apply a force such that the abutting surface 30B of the by-pass stator vanes 24 contact the outer surface 22A of the fan case 22, thereby compressing the sealing member 42. Accordingly, the sealing member 42 performs a sealing action between the vane head 30 and the fan case 22 to limit leakage from the annular gas flow path 20 through the vane-receiving apertures 22C.

There is also disclosed a method for creating a sealing engagement between, for example, the fan case 22 of the gas turbine engine 10 and the radially extending vane 24 disposed through the annular gas flow path 20 defined between the fan case 22 and the engine core. The method comprises receiving the sealing member 42, such as, but not limited to, an o-ring, within the recess 40 extending within the vane head 30 and opening to the abutting surface 30B of the vane head 30. The recess 40 circumferentially extends around the longitudinal axis of the vane body 28 and forms a closed figure.

The method further comprises creating a contact between the abutting surface 30B and the outer surface 22A of the fan case 22 once the vane body 28 of the vane 24 is inserted through its corresponding vane-receiving aperture 22C defined through the fan case 22.

The method also comprises concurrently compressing the sealing member 42 inside the recess 40 while creating the contact between the abutting surface 30B of the vane head 30 and the outer surface 22A of the fan case 22. Accordingly, the sealing 42 member exerts a force pushing the vane head 30 away from the fan case 22 when the abutting surface 30B of the vane head 30 is in contact with the outer surface 22A of the fan case 22. By compressing the sealing member 42, leaks from the annular gas flow path 20 through the vane-receiving apertures 22C are limited.

The method may further comprise engaging a periphery of the vane-receiving aperture 22C with a radial surface 38A of the neck 38 joining the vane body 28 to the vane head 30.

The method may further comprise receiving a strap 34 over a strap holder 32 defined by an outer surface 30A of the vane head 30. The strap being configured for compressing the vane head 30A against the fan case 22 to compress the sealing member 42.

It is to be understood that although the vanes have been described as being disposed through the by-pass duct, they may also be used in other components, such as, but not limited to, the compressor.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A vane assembly adapted to be disposed in a gas flow path defined by a case of a gas turbine engine, the case having a central axis, the vane assembly comprising:

a vane having a vane body configured for extending through a vane-receiving aperture in the case, a vane head disposed at one end of the vane body and configured to be disposed outside the gas flow path when the vane is inserted into the vane-receiving aperture, the vane head having an abutting surface generally transverse to the vane body and configured for contacting an outer surface of the case when the vane is inserted into the vane-receiving aperture, and a recess opening to the abutting surface, the recess circumferentially extending around a longitudinal axis of the vane and extending from the abutting surface into the vane head in a direction having a radial component relative to the central axis of the case, and a sealing member disposed within the recess.

2. The vane assembly of claim 1, wherein the recess is a cavity extending in the vane head from the abutting surface.

3. The vane assembly of claim 2, wherein the cavity has two radial surfaces extending around the longitudinal axis, the two radial surfaces being angled to retain the sealing member within the recess.

4. The vane assembly of claim 1, wherein the recess is a concave groove delimited by a radial peripheral surface of the vane head and by the abutting surface.

5. The vane assembly of claim 1, further having a neck joining the vane body to the vane head, the neck having a radial surface configured for contacting a periphery of the vane-receiving aperture defined through the case.

6. The vane assembly of claim 1, further comprising a strap holder defined by an outer surface of the vane head.

7. The vane assembly of claim 6, wherein the strap holder comprises two elongated and axially spaced-apart fingers extending outwardly from the outer surface of the vane head.

8. The vane of claim 1, wherein the sealing member is an o-ring made from elastomeric material.

9. A fan case assembly of a gas turbine engine, comprising a fan case defining an annular gas flow path and having a plurality of vanes configured for extending between an engine core of the gas turbine engine and the fan case, at least one vane of the plurality of vanes having a vane body disposed through a vane-receiving aperture defined in the fan case and a vane head disposed outside the annular gas flow path, the vane-receiving aperture smaller than the vane head such that an abutting surface defined by the vane head contacts an outer surface of the fan case, the vane head further defining a recess extending within the vane head and opening to the abutting surface and circumferentially extending around a longitudinal axis of the vane and forming a closed figure, the recess extending from the abutting surface into the vane head in a direction having an axial component relative to the longitudinal axis of the vane—the assembly further comprising a sealing member disposed within the recess.

10. The fan case assembly of claim 9, wherein the recess is a cavity extending in the vane head from the abutting surface.

11. The fan case assembly of claim 10, wherein the cavity defines two radial surfaces extending around the longitudinal axis, the two radial surfaces being angled to retain the sealing member within the recess.

12. The fan case assembly of claim 9, wherein the recess is a concave groove delimited by a peripheral surface of the vane head and by the abutting surface.

13. The fan case assembly of claim 9, the vane further having a neck joining the vane body to the vane head, the neck having a radial surface configured for contacting a periphery of a vane-receiving aperture defined through the fan case.

14. The fan case assembly of claim 9, wherein an outer surface of the vane head has a strap holder.

15. The fan case assembly of claim 14, wherein the strap holder comprises two elongated and axially spaced apart fingers extending outwardly from the outer surface of the vane head.

16. The fan case assembly of claim 9, wherein the sealing member is an o-ring made from elastomeric material.

17. A method for creating a sealing engagement between a case of a gas turbine engine and a vane extending through a gas flow path defined by the case of the gas turbine engine, the method comprising:

receiving a sealing member within a recess extending within a vane head and opening to an abutting surface of the vane head, the recess circumferentially extending around a longitudinal axis of the vane and forming a closed figure and extending from the abutting surface in a direction having an axial component relative to the longitudinal axis of the vane;

creating a contact between the abutting surface of the vane head and an outer surface of the case once a vane body of the vane is inserted through a vane-receiving aperture defined through the case, the vane-receiving aperture smaller than the vane head; and concurrently compressing the sealing member inside the recess.

18. The method of claim 17, further comprising engaging a periphery of the vane-receiving aperture with a radial surface of a neck joining the vane body to the vane head, the periphery of the vane-receiving aperture being defined between the outer surface of the case and an inner surface of the case.

19. The method of claim 17, further comprising receiving a strap over a strap holder defined by an outer surface of the vane head.

20. A gas turbine engine comprising at least one vane as defined in claim 1.

* * * * *